United States Patent [19]

Takaki et al.

[11] 4,304,456

[45] Dec. 8, 1981

[54] CONNECTOR FOR SMALL DIAMETER ELONGATED SONAR ARRAYS

[75] Inventors: Minoru Takaki, Arleta; Robert E. Schaeffer, Glendale; Gregory W. Harsha, Sylmar; James Appling, Canoga Park, all of Calif.

[73] Assignee: The Bendix Corporation, North Hollywood, Calif.

[21] Appl. No.: 102,218

[22] Filed: Dec. 10, 1979

[51] Int. Cl.[3] ..... H01R 4/64

[52] U.S. Cl. ..... 339/117 R; 339/89 M; 339/94 M

[58] Field of Search ..... 339/117 R, 94 R, 94 MC, 339/89 R, 89 C, 89 M, 90 R, 90 C, 218 RM; 285/39

[56] References Cited

U.S. PATENT DOCUMENTS

| | | | |
|---|---|---|---|
| 2,700,140 | 1/1955 | Phillips | 339/94 M |
| 3,718,350 | 2/1973 | Klein | 285/39 |
| 3,963,297 | 6/1976 | Panek et al. | 339/117 R |
| 3,997,230 | 12/1976 | Secretan | 339/94 M X |

*Primary Examiner*—Eugene F. Desmond

*Attorney, Agent, or Firm*—Robert C. Smith; William F. Thornton

[57] ABSTRACT

A structure for connecting together separate elongated small diameter sonar arrays and nonacoustic modules includes a pair of cylindrical housings which telescope together with a keyway to prevent radial movement and each of which includes means for anchoring a plurality of strength members in the form of ropes of aramid fiber. The outside one of the two telescoping housings includes external threads and an external groove for retaining a seal. The inside cylindrical housing includes two external seals, one of which is in contact with the other housing, and an external groove and shoulder. A sleeve member surrounds the telescoping housing members and includes an internal surface in contact with the other two seals, internal threads engaged with the external threads, and a shallow internal groove carrying a radially expanding retaining ring which, in operation, wedges into the shoulder and against the sleeve to transfer the load from housing to housing. A series of radial passages permits entry of a tool or tools to compress the retaining ring into the external groove on the inside cylindrical housing to permit separation of the cylindrical housing from the sleeve. Multipin electrical connector members are keyed and sealed into each of the cylindrical housings with wiring from the sonar arrays separated into individual conductors and connected to the proper connecting pins with the wires, connections and the pins encapsulated in potting compound.

5 Claims, 1 Drawing Figure

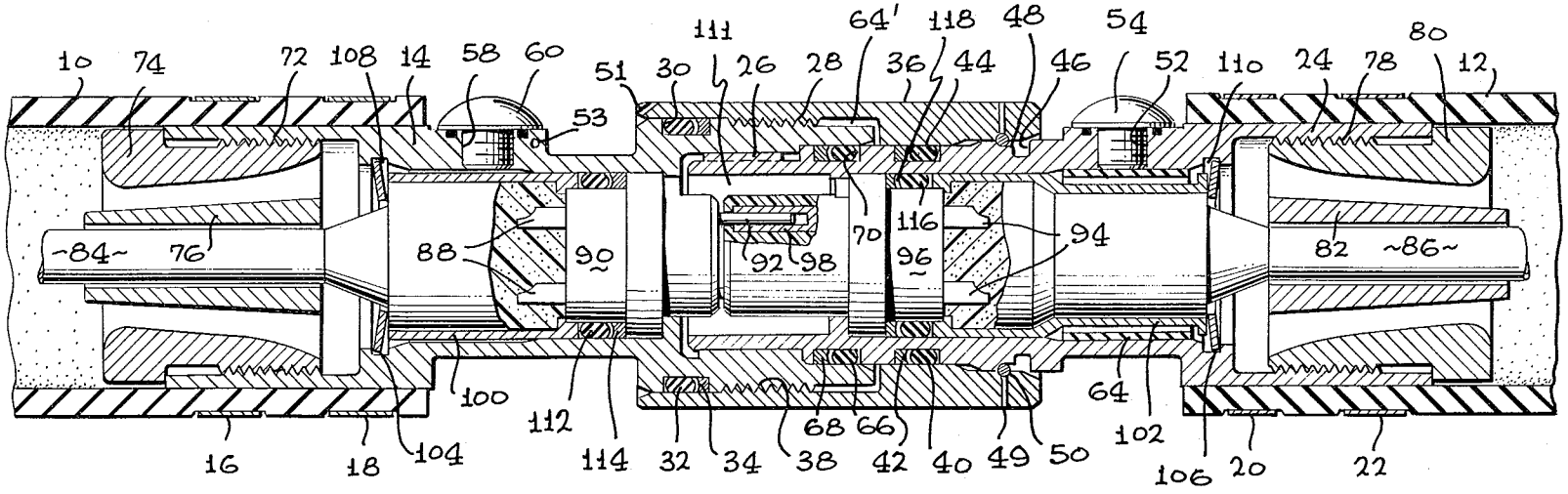
12
80
78
24
110
52
54
46
48
118
44
36
64'
28
26
111
30
51
53
60
58
14
108
72
74
10
22
20
106
102
64
50
49
40
42
66
68
38
34
32
114
112
100
104
18
16
~86~
82
94
116
96
70
98
92
90
88
76
~84~

CONNECTOR FOR SMALL DIAMETER ELONGATED SONAR ARRAYS

The invention herein described was made in the course of or under a contract with the Navy Department.

BACKGROUND OF THE INVENTION

There is a requirement for an electrical connector which is capable of linking together two sections of small diameter plastic hose containing hydrophones, amplifiers, and other electronic packages and wiring therefor, and strength members capable of withstanding towing loads, which sections must operate in and withstand water pressures at comparatively great depths without leaking. As the diameters of such arrays become smaller, it becomes more difficult to provide a connector which is capable of providing all the desired functions of assuring large numbers of reliable electrical contacts, anchoring strength members with even forces, providing sufficient strength of components to withstand heavy towing tensions without loading the electrical conductors, and assuring adequate seals to protect against leaks at substantial ocean depths. Such a connector should be reasonably convenient to connect and disconnect, and this should be possible without destroying any part of the connector. Disassembly sufficient to permit inspection and replacement of seals should also be convenient. It is further desirable that such a connector provide means for filling the plastic hose with a suitable dielectric oil.

DESCRIPTION OF THE DRAWING

The single FIGURE is a sectional view showing both parts of the connector plugged together.

DESCRIPTION OF THE PREFERRED EMBODIMENT

Referring now to the drawing, the connector shown provides mechanical and electrical connections between sonar arrays contained in first and second plastic hoses or tubes 10 and 12. Plastic hose 10 is fastened to a coupling housing 14 by means of a pair of clamp bands 16 and 18, and hose 12 is similarly clamped by means of clamp bands 20 and 22 to a coupling housing 24 designed to mate with coupling housing 14. Housing 14 and housing 24 are pushed together axially with a key 26 on the external surface of housing 24 sliding into a keyway on an inner cylindrical surface of housing 14 to prevent relative radial movement. On the surface of housing 14 are external threads 28 and a groove 30 for receiving a seal consisting of an O-ring 32 and a backup ring 34. A cylindrical coupling sleeve 36 has internal threads 38 engaged with threads 28 and a smooth internal surface against which seals 32 and 34 act to block the passage of water past threads 28 and 38. A thicker, smaller diameter internal portion of sleeve 36 extends inwardly sufficiently to provide a sliding fit with a portion of the surface of coupling housing 24 and engages a seal consisting of an O-ring 40 and a backup ring 42 positioned in a groove 44. Axially displaced a short distance from groove 44 on the surface of housing 24 is a groove 46 having next to it a shoulder 48 in which is held a retaining ring 50 which is biased to expand and which wedges tightly between housing 24 and the sleeve 36. A plurality of radial ports 49 provide access for a tool to compress ring 50 into groove 46 to permit removal of sleeve 36. This is required for inspection and servicing of seals 40, 42 and 66, 68. Sleeve 36 also includes a small bore 51 for receiving a lock wire, also secured to housing 14 through a port 53.

Drilled through the side of housing 24 is a fill port 52 which is plugged by means of a screw 54 threadedly engaged therewith. Screw 54 clamps down tightly against an O-ring seal which may be part of the screw or carried in a groove on a flat surface on housing 24. Similarly, in housing 14 a threaded vent port 58 is closed by means of a screw 60 which also seals against a flat surface on housing 14 by means of an O-ring. A cylindrical bleed and fill diaphragm 64 made of a suitable elastomer such as urethane is positioned adjacent the fill port 52 and serves to permit the entry of a suitable dielectric fluid into the interior of coupling 24 and plastic hose 12 but acts as a check valve to prevent such fluid from flowing out of port 52 when the filling fixture is removed.

The seals in grooves 30 and 44 may be considered as primary seals in that each blocks the passage of water from the outside toward the interior of coupling sleeve 36. Any water passing sleeve 30 and crossing threads 28 and 38 would reach a small annular chamber 64', as would any water passing the retaining ring 50 and getting past seals 40 and 42 in groove 44. To prevent this water from reaching the interior of the connector, an additional backup seal is employed in the form of an O-ring 66 and a backup ring 68 carried in a groove 70 in the surface of coupling housing 24.

Coupling housing 14 also has internal threads 72 which mate with threads on a member 74 which serves as an outer termination member. A generally cylindrical inner termination member 76 cooperates with member 74 to define an elongated annular passage into which are placed strands of an aramid fiber rope (not shown) which are potted in position between members 74 and 76. Similarly, coupling housing 24 includes internal threads 78 at its right end which mate with corresponding external threads on an outer termination member 80. Member 80 cooperates with a cylindrical inner termination member 82 in such way as to contain the ends of several strands of aramid fiber rope (not shown) which are fastened between these members with potting compound. Details of this anchoring structure are shown and described in copending Application Serial No. 921,547 (common assignee) filed in the name of Bruce A. Killian, now Pat. No. 4,184,784 issued Jan. 22, 1980.

Passing through the hollow interior of inner termination member 76 is an electrical cable 84 whose individual strands (not shown) are separated and soldered to a plurality of connector pins 88 which are formed in a plastic plug 90 and which terminate in male prong members 92. Similarly, electrical wires in cable 86 pass through the inner termination member 82 and individual wires (not shown) are separated and soldered to the electrical connector members 94 which are fastened in position by means of a plug 96 and which terminate in female socket members 98 mating with prongs 92.

Connector members 90 and 96 abut against internal shoulders in coupling housings 14 and 24, respectively, and each includes a cylindrical extension member or shell with shell 100 attached to connector 90 and shell 102 attached to connector 96. Each shell is filled with a polyurethane potting material to protect the separated wires connected to the respective connecting pins 88 and 94. Abutting against the ends of shells 100 and 102 are retainer rings 104 and 106, respectively, which are biased to expand into grooves 108 and 110, respectively. Any leakage from the interior of hoses 10 or 12 is blocked from reaching a chamber 111 containing the exposed connector members 92 and 98 by means of an O-ring 112 and backup ring seal 114 in connector 90 and an O-ring 116 and backup ring seal 118 in connector 96.

When the arrays are separated and it is desired to connect them, it is, of course, necessary to plug the proper members 92 into the proper sockets 98. This radial orientation is important, and this is assured in that coupling housing 24 will telescope into housing 14 only when key 26 is aligned with the keyway in housing 14. The plug members 90 and 96 are individually keyed to the internal surfaces of housing members 14 and 24. This makes the electrical connections and engages seals 66, 68. To assure positive locking in position plus watertight seals, the sleeve 36, which is carried on housing 24, is threadedly engaged with the adjoining threads on the outside of housing 14, thus pulling itself toward the left and sealing against seals 32, 34 and 40, 42. As sleeve 36 moves to the left, it carries retaining ring 50 with it, wedging it tightly between itself and shoulder 48. At this point the connection is secure and a safety wire can be fastened between bore 51 and port 53. The safety wire provides a visual inspection that the coupling is in the fully mated and locked condition. In the event that it is not installed, self locking will still be present by virtue of the internal friction of two O-rings 30 and 44. The hoses 10 and 12 will be filled with dielectric fluid by removing screws 54 and 60 at the end of each hose prior to interconnecting the couplings 14, 24 and 36.

When it is desired to disconnect the arrays or modules, the safety wire is removed and sleeve 36 is turned on its threads sufficient to disengage housing 14 from housing 24 and sleeve 36. By applying force through ports 49 to the ring 50 and by pulling sleeve 36 quickly axially away from housing 24 (leaving the retaining ring 50 in its groove 46 on housing 24), the disassembly of body and sleeve 24 and 36 for inspection of O-rings 40 and 66 can be accomplished.

The structure described provides good protection against leakage of sea water into the electrical connecting pins, it provides great strength for anchoring the strength members (aramid ropes), it provides a strong structure in the retaining ring arrangement for carrying the tension load, and yet the outer sleeve is relatively easily moved to remove the wedging action of the retaining ring to permit disassembly to inspect and replace the seals as needed, or for any other purpose.

The present invention is not limited to the exact configuration shown, and modifications will be obvious to those skilled in the art. For example, threaded members could be installed in radial ports 49 to compress ring 50. In an entire towed sonar system, some of the modules connected with the above described structure are nonacoustic and may be connected by means of the above described structure to either an acoustic module or array or to another nonacoustic module.

We claim:

1. A connector assembly for fastening together two elongated sonar arrays or nonacoustic modules, each of said arrays including a length of flexible hose, hydrophones, wiring, a plurality of strength members, and a hydrocarbon dielectric material in said hose, which arrays are towed through a body of water, said assembly comprising first and second generally cylindrical coupling housings with one said housing including a section which telescopes over the other said housing, said housings including a key and keyway preventing relative radial movement of said housings, each said housing having an internally threaded cylindrical section at its end opposite said key and keyway and one end of a section of flexible hose clamped to the exterior surface of each said internally threaded cylindrical section, strength member retaining means threadedly engaged with the internal threads of each said cylindrical coupling housing, electrical plug members carried internally of each of said cylindrical coupling housings with female electrical connecting pins in one said plug member and male connecting pins in the other said plug member, a plurality of electrical wires connected to said pins, and potting compound within said coupling housings enclosing said wires and portions of said pins, fluid seal means adjacent each said plug member for effecting a fluid seal between each said plug member and the internal surface of its cylindrical coupling housing, and a coupling sleeve member carried on the one of said coupling housings which slips inside the other, said sleeve member having internal threads engaged with external threads on the other said coupling housing, and a shallow annular groove on the inside surface of said sleeve member, liquid seal means between each of said cylindrical coupling housings and said coupling sleeve member, a groove and a shoulder on the surface of said one coupling housing, a retaining ring in said shallow annular groove which in operation is wedged into said shoulder to prevent tensile forces on said assembly from separating said cylindrical coupling housings, and radial passageways in said coupling sleeve member communicating with said shallow annular groove such that means exerting force through said passageways can compress said retaining ring into said groove on said one coupling housing to permit separation of said coupling sleeve member from said one coupling housing.

2. A connector assembly for connecting two elongated sonar arrays or nonacoustic modules, each array including a length of flexible hose, hydrophones, wiring, and hydrocarbon dielectric material in said hose, which arrays are adapted to be towed through a body of water, said assembly comprising first and second generally cylindrical coupling housings with one of said housings including a section which telescopes over the other said housing, said housings including a key and keyway preventing relative radial movement of said housings and one end of a section of flexible hose clamped to the exterior surface of each of said cylindrical coupling housings at its end opposite said key and keyway, one of said cylindrical coupling housings including a fill port for installation of said hydrocarbon dielectric material and the other said cylindrical coupling housings including a vent port for permitting the escape of air as its array is filled with said hydrocarbon dielectric material, and means closing said ports;

one of a pair of mating electrical connector members carried in each of said cylindrical coupling housings and connected to said wiring, a coupling sleeve member carried on the one of said coupling housings which slips inside the other, said sleeve member having internal threads engageable with external threads on the other of said coupling housings, a shallow annular groove on the inside surface of said sleeve member, liquid seal means between each of said cylindrical coupling housings and said coupling sleeve member, a groove and a shoulder on the surface of said one coupling housing, a retaining ring in said shallow annular groove which in operation is wedged into said shoulder to prevent tensile forces on said assembly from separating said cylindrical coupling housings, and radial passageways in said coupling sleeve member communicating with said shallow annular groove, such that means exerting force through said passageways can force said retaining ring into said groove on said one coupling housing to permit separation of said coupling sleeve member from said one coupling housing.

3. A connector assembly as set forth in claim 2 wherein a cylindrical diaphragm of elastomeric material is positioned inside said one cylindrical coupling housing adjacent said fill port and serves as a check valve to prevent said hydrocarbon dielectric material from flowing out of said fill port when said closing means is not present.

4. A connector assembly as set forth in claim 2 wherein liquid seal means is positioned between said electrical connector members and said cylindrical coupling housings.

5. A connector assembly as set forth in claim 2 wherein said one cylindrical coupling housing includes a larger diameter external portion adjacent said shoulder, said coupling sleeve member has a smaller diameter internal portion adjacent one of said liquid seal means and axially displaced from said larger diameter external portion a distance approximately equal to the distance said retaining ring travels from its wedged operating position to a position over said groove.

* * * * *